United States Patent [19]

Filippov et al.

[11] 4,455,177

[45] Jun. 19, 1984

[54] METHOD AND APPARATUS FOR CHEMICAL HEAT TREATMENT OF STEEL PARTS UTILIZING A CONTINUOUS ELECTRIC FURNACE

[76] Inventors: Vladimir I. Filippov, ulitsa Marxistskaya, 5, kv. 226; Nikolai I. Parshin, ulitsa Zelenodolskaya, 14, korpus 2, kv. 16; Igor V. Barabanov, prospekt Budennogo, 28, korpus 1, kv. 8; Eduard N. Marmer, Novolesnaya ulitsa, 17 "A", kv. 48; Alexandr F. Puzanov, Bolshoi Fakelny pereulok, 3, kv. 26; Alexandr B. Lobanov, ulitsa Zelenodolskaya, 14, korpus 2, kv. 21; Jury P. Usaty, ulitsa Tashkentskaya, 4, korpus 2, kv. 143; Vladimir I. Gerasimov, ulitsa Zelenodolskaya, 14, korpus 2, kv. 12, all of Moscow; Arkady K. Tikhonov, ulitsa Dzerzhinskogo, 69, kv. 228; Viktor N. Turulin, ulitsa Dzerzhinskogo, 72, kv. 82, both of Tolyatti, all of U.S.S.R.

[21] Appl. No.: 417,553

[22] Filed: Sep. 13, 1982

[51] Int. Cl.[3] ..... C21D 1/74; C21D 9/67

[52] U.S. Cl. ..... 148/155; 266/250; 266/252; 266/253; 266/259; 148/16.5

[58] Field of Search ..... 266/249–255, 266/271, 262–264; 432/242, 249, 237, 250; 148/155, 156, 157, 153, 16, 16.5

[56] References Cited

U.S. PATENT DOCUMENTS

| | | | |
|---|---|---|---|
| 3,778,221 | 12/1973 | Bloom | 432/11 |
| 3,830,479 | 8/1974 | Knowles | 266/250 |
| 3,972,513 | 8/1976 | Mobius et al. | 266/130 |

FOREIGN PATENT DOCUMENTS

| | | | |
|---|---|---|---|
| 456569 | of 1976 | U.S.S.R. . | |
| 855013 | 8/1981 | U.S.S.R. | 266/105 |

*Primary Examiner*—L. Dewayne Rutledge
*Assistant Examiner*—Christopher W. Brody
*Attorney, Agent, or Firm*—Steinberg & Raskin

[57] ABSTRACT

A continuous electric furnace for chemical heat treatment of steel parts comprises a parts heating chamber, a parts vertical supply chamber and a cooling chamber, all arranged in line. The parts vertical supply chamber is connected to a processing chamber wherein a hearth is equipped with a vacuum seal serving to separate the processing chamber from the other chambers in the process of chemical heat treatment of parts. The heating and cooling chambers comprise extension stops and heat screens located on the side of the parts vertical supply chamber, and the hearths movable reciprocally in a horizontal direction.

8 Claims, 3 Drawing Figures

METHOD AND APPARATUS FOR CHEMICAL HEAT TREATMENT OF STEEL PARTS UTILIZING A CONTINUOUS ELECTRIC FURNACE

BACKGROUND OF THE INVENTION

The present invention relates to vacuum and gas-filled electrothermal units and, more specifically, to continuous electric furnace for chemical heat treatment of steel parts.

The invention can most advantageously be used for vacuum carburizing in electrical engineering, automotive industry, and in other fields of machine building. In addition, the invention can be employed in chemical heat treatment of products manufactured by powder metallurgy techniques.

The invention is also applicable in such processes as vacuum brazing and impregnation of surfaces with various elements, for example, silicon, titanium, boron, etc.

The maximum efficiency in chemical heat treatment of parts is achieved through the use of continuous furnaces.

Known in the art is a case-hardening pusher-type furnace (cf. the handbook "Electrothermic Equipment" edited by A. P. Altgauzen, Moscow, 1967, p. 178, FIG. 5-133), comprising charging and discharging mechanisms, a case-hardening chamber, and a cooling chamber arranged in line. The furnace incorporates a pusher serving to supply parts to the case-hardening chamber, and a moving mechanism serving to feed the parts into the cooling chamber. The heating chamber is furnished with a fan for circulating the medium during the carburizing procedure. Such furnaces are employed by the Aichelin and Halcroft companies.

The furnace operates as follows. The parts are loaded into containers. A container filled with the parts is placed on the charging mechanism, and the pusher moves it into the casehardening chamber. A chamber door opens, and the parts are fed through the door opening to the heating chamber wherein they are heated to the carburizing temperature while travelling through the chamber. The furnace commonly employs a flame curtain to maintain the medium in the case-hardening chamber. The case-hardening chamber is filled with saturating gas supplied thereto. On completion of the carburizing procedure, discharge doors open, and the charge is forwarded into the cooling chamber.

The furnace is a fire- and explosion-hazardous unit which contaminates the workshop environment, and special-function ventilation is required. The equipment set of the furnace must include environment-control generators with a high degree of purification, and must also incorporate natural gas supply appliances of the furnace. The carbon potential must be accurately controlled inside the furnace, since it can be easily disturbed during charging and discharging operations. Besides, the structural members of the furnace (including heaters and lining) are not adapted for increasing the temperature in the furnace because of heavy soot precipitation leading to failures of the heaters, hence, the furnace output drops.

There is known in the art a continuous vacuum furnace for heat treatment with provisions for vacuum cooling and further inert gas cooling (cf. Data Sheet No. 771, type LV, model CVCQ-202436, Hays company), comprising a charging and a discharging chambers equipped with vacuum seals, a case-hardening chamber with heat insulation made of fiber material, and a vacuum cooling chamber.

The furnace operates as follows. A container filled with products is charged into the charging chamber, with the seal of the case-hardening chamber closed. Then the charging chamber door is shut, the chamber is evacuated for a predetermined vacuum, and a vacuum seal wherethrough the charging chamber communicates with the case-hardening chamber opens for passing the container to the case-hardening chamber wherein the products in the charge are heated to the carburizing temperature during movement of the container through the chamber, and are impregnated with carbon. On completion of the full case-hardening cycle, the products are forwarded to the cooling area wherefrom they are moved through another vacuum seal to the inert gas quick-cooling area, and then to the discharging chamber.

The construction of the prior-art furnace does not provide for producing a uniform carburized layer because the products located in the container during heating of the charge do not absorb carbon equally at different temperatures, hence, the carburized layer thickness varies. Besides, the furnace of the foregoing design requires large amounts of carburizing gas and electric power since the furnace must be filled with reactive gas to capacity.

Also known in the art is a pusher-type furnace (cf. USSR Inventor's Certificate No. 601317, C21D 9/00, 1978), comprising a charging chamber, a discharging chamber, a heating chamber, an intermediate chamber equipped with heating elements and attached by a holder to a pusher serving to move the intermediate chamber in a vertical direction, and a cooling chamber.

The furnace operates as follows. Products to be treated are placed into pans. Each pan is installed into the charging chamber, and the pusher moves the pan into the heating chamber after the seal opens, wherein the pan is held during a predetermined time. Then the next pan is charged into the furnace. During each push, the pan heats up gradually and comes under the intermediate chamber. When the intermediate chamber moves downward, a platform of the pan appears to be in the heat treatment area. After a certain exposive period, the pusher returns the intermediate chamber to the initial position, the pan with the products remains in place, for a certain period of time, and then the pusher sends the pan to the cooling chamber. From the cooling chamber the pan is supplied to the discharging chamber. After that, the procedure is repeated. The intermediate chamber of the above design is not adapted for easy sealing of the processing chamber required for chemical heat treatment accomplished in the vacuum furnace. Besides, the construction of the furnace is complicated because of the above-mentioned design of the movable chamber.

There is also known a continuous electric furnace for chemical heat treatment of parts (cf. USSR Inventor's Certificate No. 456569, F 27 B 9/22, 1976), comprising a parts heating chamber separated into different heating areas, a separate heat-insulated high-temperature processing chamber connected to a parts vertical supply chamber, and a cooling chamber. The heating chamber, the chamber of vertical supply of parts to the processing chamber, and the cooling chamber are aligned and the processing chamber is located outside of the line for continuous horizontal supply of parts.

The furnace operates as follows. Containers with parts fed to the heating chamber travel along the chamber and heat up gradually. After the parts are heated to a predetermined temperature, they are fed to the vertical supply chamber wherefrom the parts are moved to the processing chamber serving for treatment of parts at a preset temperature. On completion of treatment inside the processing chamber, the containers with parts move down and are sent further to the cooling chamber.

There are no provisions in the prior-art furnace for sealing the processing chamber required to permit efficient chemical heat treatment of parts.

SUMMARY OF THE INVENTION

It is an object of the present invention to provide a continuous electric furnace for chemical heat treatment of steel parts, the additional structural members whereof, mutual arrangement of said members and interaction thereof would minimize the effects of the temperature field on the furnace sealing elements during the treatment procedure, and thus would permit sealing the processing chamber for a period ofchemical heat treatment, and, hence, extending the manufacturing range of the furnace, reducing the saturating gas and electric power consumption, and improving the quality of parts being treated.

With this and other objects in view, a continuous electric furnace for chemical heat treatment of steel parts is herein proposed, comprising a parts heating chamber, a parts cooling chamber and a processing chamber connected to a chamber for vertical supply of parts thereto, located between the heating and cooling chambers and aligned therewith, with a line formed for continuous horizontal supply of parts, wherein, according to the invention, the parts heating and cooling chambers incorporate extension stops and heat screens disposed on the side of the vertical supply chamber, with the hearths of said chambers adapted for horizontal reciprocal motion, and with a hearth of the processing chamber equipped with a vacuum seal serving to separate the processing chamber from other chambers of the furnace during chemical heat treatment of parts.

The use of the above-mentioned structural members, and the mutual arrangement and interaction thereof during operation of the continuous electric furnace for chemical heat treatment of steel parts permit sealing the processing chamber during chemical heat treatment, improving the operating thermal characteristics of the furnace, and, hence, uniform heating of products, with the result that the quality of products being treated is improved and the treatment costs are cut down.

BRIEF DESCRIPTION OF DRAWINGS

The invention will now be described in greater detail with reference to a preferred embodiment thereof taken in conjunction with the accompanying drawings, wherein.

DETAILED DESCRIPTION OF THE INVENTION

Figure 1:
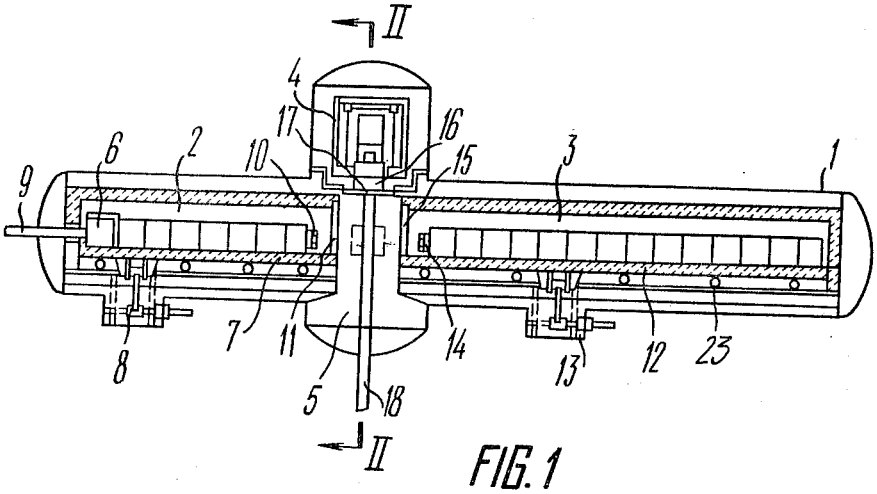
FIG. 1 is a longitudinal sectional view of a continuous electric furnace for chemical heat treatment of steel parts, according to the invention.

A continuous electric furnace for chemical heat treatment of steel parts, comprises a case 1 (FIG. 1) accommodating a heating chamber 2, a cooling chamber 3, and a processing chamber 4 connected to a chamber 5 for vertical supply of parts 6. The heating chamber 2 is made of ceramic refractory materials. A hearth 7 of the heating chamber 2 is coupled with a mechanism 8 serving to move the hearth 7. A mechanism 9 for moving the parts 6 is disposed on the charging side of the heating chamber 2. An extension stop 10 and a heat screen 11 are arranged on the end side of the heating chamber 2 facing the chamber 5 for vertical supply of the parts 6.

The cooling chamber 3 is made of ceramic refractory materials. A hearth 12 of the cooling chamber 3 is coupled with a mechanism 13 for moving said hearth. An extension stop 14 and a heat screen 15 are disposed on the end side of the cooling chamber facing the chamber 5 for vertical supply of the parts 6.

The processing chamber 4 is made of carbon-graphite materials. A hearth 16 of the processing chamber 4 is equipped with a vacuum seal 17 coupled with a mechanism 18 used to move said hearth and to separate the processing chamber 4 from the other chambers 2 and 3 of the furnace during chemical heat treatment of the parts 6.

Figure 2:
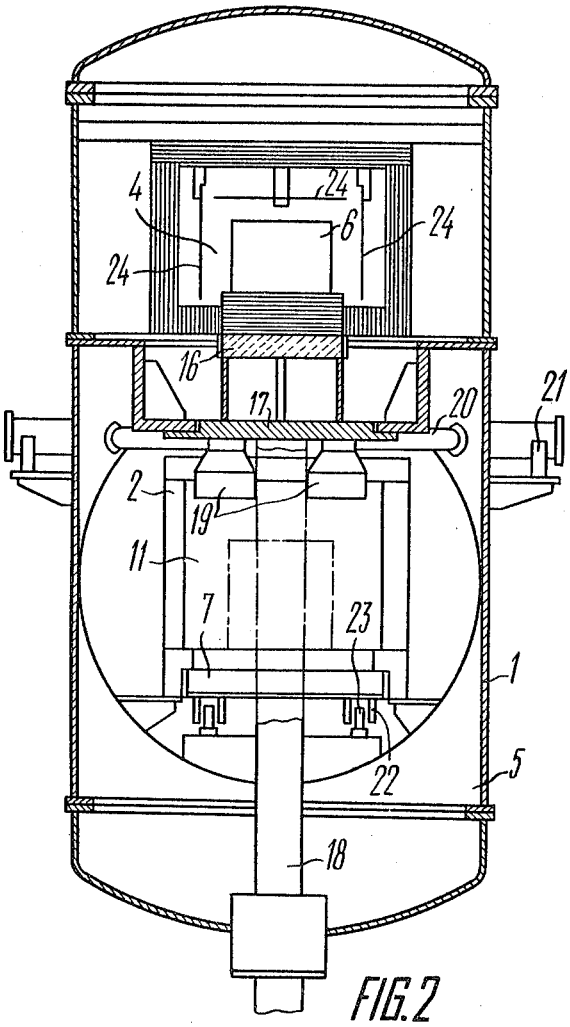
FIG. 2 is a sectional view taken along line II—II of FIG. 1, and according to the invention.

Referring to FIG. 2, the view taken along line II—II of FIG. 1 shows mutual arrangement of the heating chamber 2 and processing chamber 3, the construction of the heat screens 11 (FIG. 1) attached by brackets 19 to a shaft 20 revolving about journals 21, the construction of the movable hearth 7 in the heating chamber 2 wherein it travels on guides 22 by means of rollers 23, and the arrangement of heating elements 24 inside the processing chamber 4.

The continuous electric furnace for chemical heat treatment of steel parts operates as follows.

Figure 3:
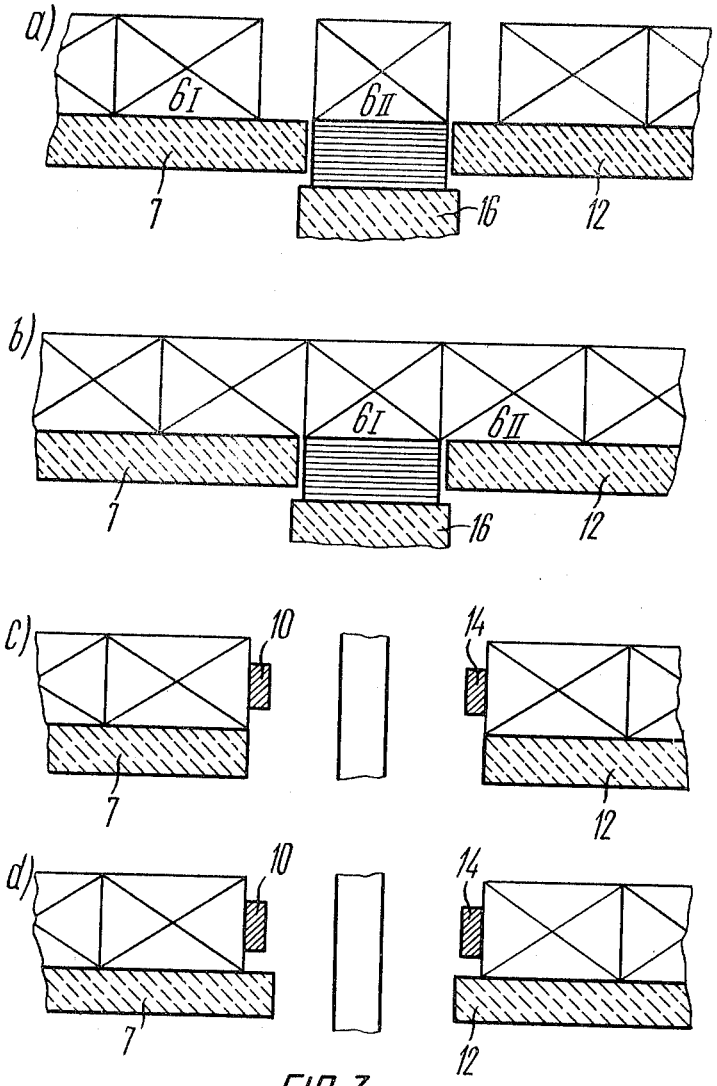
FIG. 3 is a diagram showing movement of parts during chemical heat treatment, according to the invention.

The parts 6 charged in succession into the heating chamber 2 (FIG. 1) are moved by the mechanism 9 along the furnace over the hearths 7, 12 and 16. During motion of the parts 6, the hearths 7, 12 and 16 stay in positions indicated in FIGS. 3*a* and *b*, with the part $6_I$ displaced from the hearth 7 to the hearth 16, and with the part $6_{II}$ displaced from the hearth 16 to the hearth 12 (FIG. 3*b*). After that, the hearth 7 (FIG. 3*c*) travels to the full left-hand position, the hearth 12 travels to the full right-hand position, and the hearth 16 rises to the top position thereof. The stops 10 and 14 extend, the hearths 7 and 12 move to the intermediate position thereof (FIG. 3*d*), and the stops 10 and 14 hold the parts 6 in positions shown in FIG. 3*c*. The heat screens 11 and 15 (FIG. 1) close down. The hearth 16 lifts the part 6 to the processing chamber 4 and separates it tightly from the internal space of the furnace. On completion of treatment of the part 6 in the processing chamber 4, the hearth 16 is lowered to the position shown in FIG. 3*a*, the mechanism 9 moves the parts 6 to the next position, and the cycle is repeated.

When the electric furnace is used for chemical heat treatment of products, for example, for vacuum carburizing, the parts 6 charged into the heating chamber 2 are subjected to initial heating in vacuum or in a medium of neutral gas at a low pressure. Inside the processing chamber 4, the parts are subjected to carburizing in a medium of carbon-containing gas. During this procedure, the reactive gas can be refreshed repeatedly by pumping it out and injecting fresh portions of gas. The part 6 charged into the cooling chamber 3 is exposed to diffusion and to another heat treatment in vacuum or in a neutral gas medium. When the parts 6 are discharged from the electric furnace, the hearth 12 is placed to the position shown in FIG. 3*c*.

The present invention permits attaining the aim mentioned above. The use of the stops 10 and 14 (FIG. 1) and of the heat screens 11 and 15 permits minimizing the effects of the temperature field on the sealing members of the furnace vacuum seal 17 during the treatment procedure, improving uniform heating of the parts 6, and minimizing the electric power consumption. Since there are provisions in the furnace for sealing the processing chamber 4, the manufacturing range of the furnace can be widened, the electric power consumption per ton of output product can be reduced by 1.5 or 2 times, and the reactive gas consumption can be reduced by 8 to 10 times. The electric furnace of this construction permits carrying out various chemical heat treatment procedures and manufacturing high-quality products. The electric furnace according to the invention precludes effluence of harmful gas impurities and thus contributes to improved production conditions.

What is claimed is:

1. A continuous furnace for chemical heat treatment of parts, comprising:

a heating chamber for heating said parts, a first hearth situated in said heating chamber to support said parts in said heating chamber, with the parts arranged in succession in a linear direction, said first hearth being mounted for reciprocal motion in a path which is substantially parallel to said linear direction;

a cooling chamber for cooling said parts, a second hearth situated in said cooling chamber to support said parts in said cooling chamber with the parts arranged in succession in said linear direction, said second hearth being mounted for reciprocal motion in a path which is substantially parallel to said linear direction;

a processing chamber for chemical heat treatment of said parts;

support means disposed between said heating and cooling chambers for movement between a first position wherein said support means is adapted to receive and support at least a leading one of said parts from said heating chamber and a second position wherein said at least one supported part is situated in said processing chamber;

stop means installed in said heating and cooling chambers for restraining movement of the parts with respect to the respective hearths supporting the same when said first and second hearths are moved in directions towards each other to an intermediate position;

heat screens installed in said heating and cooling chambers on the sides of said support means; and means associated with said support means for sealing said processing chamber when said support means is in said second position.

2. The furnace of claim 1, in which said stop means comprises two stops, each stop adapted to extend across said linear direction when said first and second hearths are moved towards each other to said intermediate position, and to retract when said first and second hearths are moved towards each other past said intermediate position, said sealing means is a vacuum seal disposed on said support means, and additionally comprising a third hearth disposed on said vacuum seal.

3. The furnace of claim 1 in which said linear direction is substantially horizontal, and said support means is adapted to move in a substantially vertical direction.

4. The apparatus of claim 1, comprising two pairs of journals, a first pair affixed to the outside of said furnace adjacent said heating chamber, and a second pair affixed to the outside of said furnace adjacent said cooling chamber, two rotatable shafts, each disposed in a respective pair of journals, and two brackets, each bracket connecting a respective rotatable shaft with a respective heat screen.

5. The apparatus of claim in, additionally comprising two pairs of guides, a first pair disposed on an underside of said first hearth and a second pair disposed on an underside of said second hearth, and a plurality of rollers situated on said furnace, at least one roller engaged with said first pair of guides and at least one roller engaged with said second pair of guides.

6. A method for continuously heat treating parts, comprising the steps of continuously passing said parts through a heating chamber, heating said parts passing through said heating chamber, continuously passing said parts through a cooling chamber, cooling said parts passing through said cooling chamber, and prior to cooling said parts in said cooling chamber, passing at least a portion of said parts into a processing chamber for chemical heat treatment of said parts, retracting a first hearth supporting parts passing through said heating chamber and a second hearth supporting parts passing through said cooling chamber from one another when said at least a portion of said parts is passed to said processing chamber, extending said retracted first and second hearths towards one another to an intermediate position, actuating stop means for restraining movement of said parts when said first and second hearths are moved towards each other, extending a pair of heat screens across a direction of movement of said parts through said heating and cooling chambers, as said stop means is actuated, sealing said processing chamber when heat treatment is conducted therein, and deactivating said stop means, retracting said heat screens, and further extending said first and second hearths towards one another when treatment of said at least portion of said parts in said processing chamber is completed and said at least a portion of said parts is removed from said processing chamber and passed to said cooling chamber.

7. The method of claim 6 for continuously chemically heat treating a plurality of steel parts, which comprises the steps of heating said parts in a low pressure environment in said heating chamber, vacuum carburizing said steel parts in said processing chamber, and cooling said parts in a low pressure environment in said cooling chamber.

8. The method of claim 6 in which said at least a portion of said parts is passed to and removed from said processing chamber in a direction substantially perpendicular to the direction of movement of said parts through said heating and cooling chambers, and said processing chamber is vacuum sealed when heat treatment is conducted therein.

* * * * *